US006400248B1

(12) United States Patent
Konz

(10) Patent No.: US 6,400,248 B1
(45) Date of Patent: Jun. 4, 2002

(54) DEVICE FOR ABSORBING ELECTRIC NOISE

(75) Inventor: Oliver Konz, Ilshofen (DE)

(73) Assignee: Wurth Elektronik GmbH & Co. KG, Niedernhall (DE)

( * ) Notice: Subject to any disclaimer, the term of this patent is extended or adjusted under 35 U.S.C. 154(b) by 0 days.

(21) Appl. No.: 09/423,581

(22) PCT Filed: Mar. 11, 1999

(86) PCT No.: PCT/EP99/01562

§ 371 (c)(1),
(2), (4) Date: Nov. 10, 1999

(87) PCT Pub. No.: WO99/48198

PCT Pub. Date: Sep. 23, 1999

(30) Foreign Application Priority Data

Mar. 13, 1998 (DE) ..... 198 11 048

(51) Int. Cl.[7] ..... H01F 27/02
(52) U.S. Cl. ..... 336/92; 336/175; 336/176
(58) Field of Search ..... 336/92, 176, 90, 336/81 R, 210, 212, 182, 183, 229; 333/12

(56) References Cited

U.S. PATENT DOCUMENTS

| | | | | |
|---|---|---|---|---|
| 3,462,715 A | | 8/1969 | Schor | 333/79 |
| 4,972,167 A | * | 11/1990 | Fujioka | 336/92 |
| 5,334,955 A | | 8/1994 | Strnad | 333/12 |
| 5,373,277 A | | 12/1994 | Naito | 336/92 |
| 5,486,803 A | | 1/1996 | Igarashi et al. | 336/92 |
| 5,506,909 A | * | 4/1996 | Perng | 336/176 |
| 5,703,557 A | | 12/1997 | Osada et al. | 336/92 |
| 5,942,964 A | * | 8/1999 | Takeuchi | 336/92 |
| 6,078,241 A | * | 6/2000 | Watanabe et al. | 336/92 |

FOREIGN PATENT DOCUMENTS

| | | |
|---|---|---|
| DE | 39 32 021 A1 | 4/1990 |
| DE | 40 04 211 A1 | 8/1990 |
| DE | 40 16 809 A1 | 12/1990 |
| DE | 41 04 100 C2 | 9/1991 |
| DE | 42 01 926 C2 | 8/1992 |
| DE | 42 23 044 A1 | 1/1993 |
| DE | 43 02 650 A1 | 8/1993 |
| DE | 94 08 883 | 9/1994 |
| DE | 197 30 108 A1 | 1/1998 |
| DE | 197 30 109 A1 | 2/1998 |
| EP | 0 452 992 A2 | 10/1991 |

* cited by examiner

*Primary Examiner*—Lincoln Donovan
*Assistant Examiner*—Tuyen T. Nguyen
(74) *Attorney, Agent, or Firm*—Quarles & Brady LLP

(57) ABSTRACT

A device for absorbing the electric noise on a cable contains a casing formed from two halves, in each of whose halves can be fixed a ferrite element. The two ferrite elements enclose the cable with the casing closed. A locking device keeps the two casing halves interconnected. The locking device is entirely housed within the casing walls, so that the casing cannot be unintentionally opened.

22 Claims, 4 Drawing Sheets

DEVICE FOR ABSORBING ELECTRIC NOISE

Figure 1:
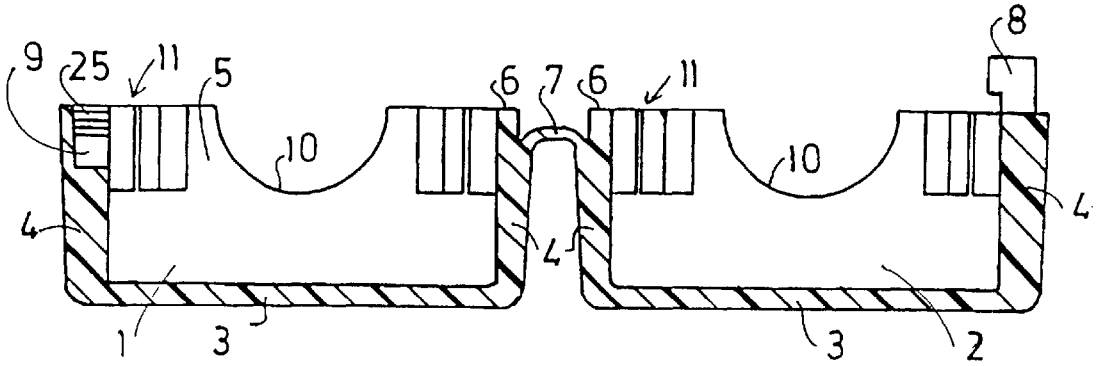

The invention is directed at a device for absorbing electric noise. It has long been known that the electric noise on the line can be reduced with the aid of ferromagnetic material elements (U.S. Pat. No. 3,462,715).

Such a device is already known (EP-A-452992), in which two half-elements made from ferromagnetic material are housed in split casing, whose bases have elastic pretensioning means, which press the two magnetic elements onto one another.

The problem of the invention is to provide a simply constructed and reliably operating device for absorbing electric noise.

To solve this problem the invention proposes a device having the features of claim 1. Further developments of the invention form the object of the dependent claims, whose wording, like that of the abstract, is made by reference into part of the content of the description.

The device is used in such a way that the two elements made from the noise-preventing material and referred to hereinafter as ferrite elements, are inserted in the part shells of the casing and then the casing is placed around the electric cable. According to a further development of the invention the device for fixing the ferrite elements acts on at least one frontal corner edge of the ferrite element, which is perpendicular to the interface between the two ferrite elements. Thus, the fixing device engages in such a way that no forces arise which press the ferrite elements towards the interface, so that they cannot give way in the opposite direction.

According to a further development, the fixing device has a web engaging on the ferrite element and located in the vicinity of and sloping towards the corner of the casing half. During the manufacture of the casing, said web can be easily manufactured without additional costs.

The web can in particular have a notch in which comes to rest the corresponding corner of the ferrite element.

According to the invention, said web is shaped on the one hand on the end wall and on the other on the side wall of the casing. Between the two points where it is shaped, it is preferably free, so that it can apply a certain tension.

It is also possible for the web to be split, so that the mutually associated ends of the two parts of the web can engage on the ferrite element.

It can in particular be provided that the facing ends of the two web parts are bevelled and the bevel is in particular chosen in such a way that the sloping edges engage flat on the ferrite elements.

According to the invention, in the case of the two-part web, one web part is shaped on the end wall and the other on the side wall of the part shell of the casing.

According to the invention, the web or the two web parts do not extend up to the base of the part shells of the casing.

According to the invention, the device can have a locking device for locking the casing in the closed state. This ensures that the casing does not open again, so that the device remains effective. Advantageously, the locking device is so positioned and constructed that it does not project over the outside of the closed casing and is in particular entirely located within the casing. This excludes an intentional or unintentional access to the locking device.

The locking device can have a lug or tab shaped onto one edge of a casing half and which locks in a recess in the edge of the other casing half. As a result of this arrangement on the edge, it is possible to ensure that the lug or tab is no longer accessible when the casing is closed. The recess may only be open in the interior of the casing.

Locking can in particular be such that it takes place on the terminal edges of the recess.

According to a further development, the tab has a resilient locking tongue in the vicinity of at least one of its facing terminal ends.

According to the invention, the locking can be such that it opposes opening and this can e.g. be achieved through the nature of the spring positioning.

In order to, if necessary, open the locking device again, according to the invention the casing has an opening through which a special tool can be passed through to enable action to take place on the locking device. This enables a specialist to open and optionally replace the device.

The through opening for the cable can, according to the invention, be formed by two recesses in the end walls of the two casing halves. On closing the casing the two facing recesses then form the through opening. The two recesses can be displaced along the associated edges of the casing halves. This gives rise to constrictions, which can be used for compensating different cable diameters, without said recesses having to diverge from the smooth shape or form.

According to the invention, the through openings need not be circular and can e.g. be oval or elliptical.

The two part shells can e.g. be interconnected by a film hinge. However, it is also possible to manufacture them separately and interconnect them by plugging.

Further features, details and advantages of the invention can be gathered from the following description of a preferred embodiment and with reference to the attached drawings, wherein show:

FIG. 1 A cross-section through an opened casing.

Figure 2:
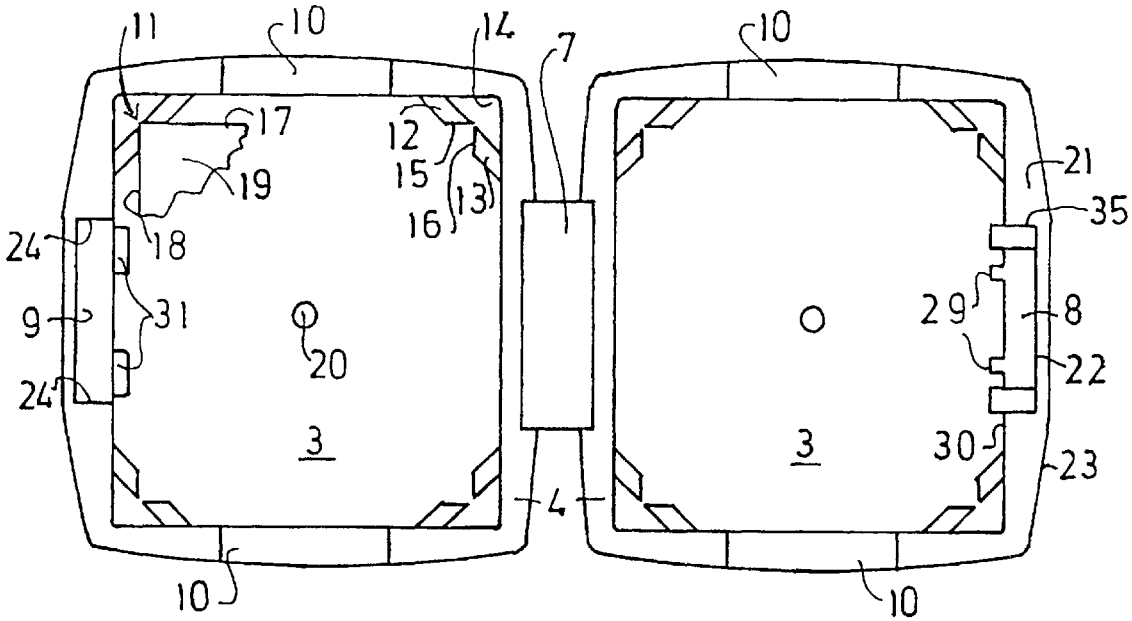

FIG. 2 A plan view of the open casing from above in FIG. 1 with an intimated ferrite element.

Figure 3:
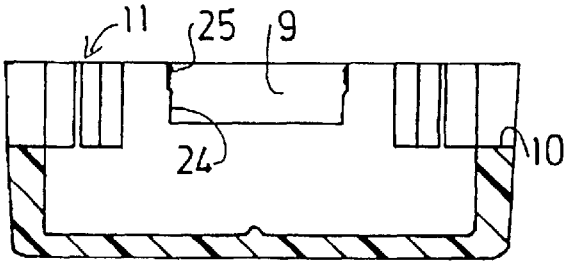

FIG. 3 A longitudinal section through one casing half.

Figure 4:
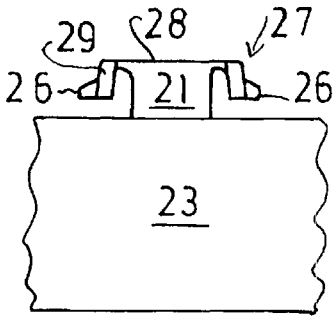

FIG. 4 A partial view of the tab of the locking device.

Figure 5:
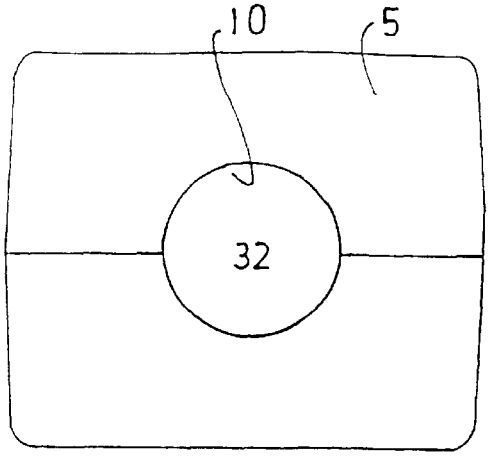

FIG. 5 A front view of a closed casing in a first embodiment.

Figure 6:
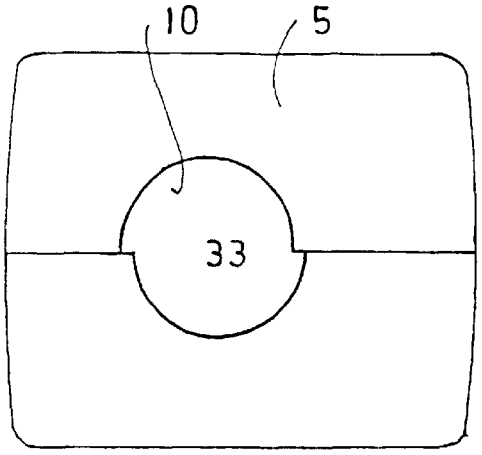

FIG. 6 A front view of a second embodiment.

Figure 7:
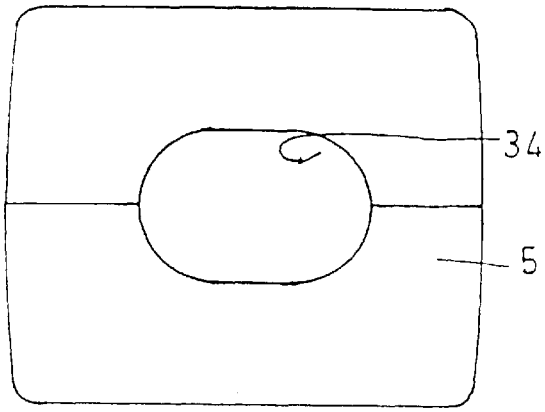

FIG. 7 A front view of a third embodiment.

Figure 8:
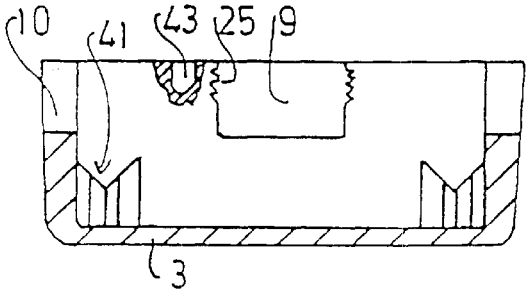

FIG. 8 A view corresponding to FIG. 3 for a further embodiment.

Figure 9:
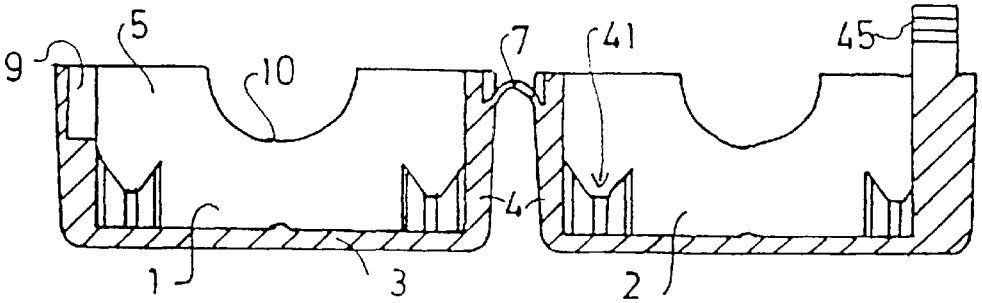

FIG. 9 A view corresponding to FIG. 1 for the embodiment of FIG. 8.

Figure 10:
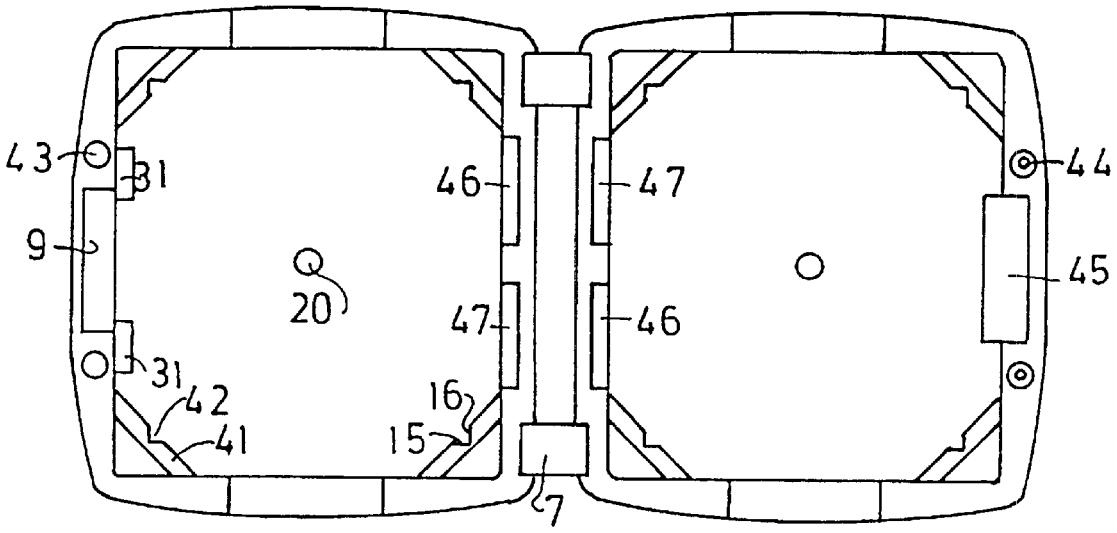

FIG. 10 A plan view corresponding to FIG. 2 for the embodiment of FIGS. 8 and 9.

Figure 11:
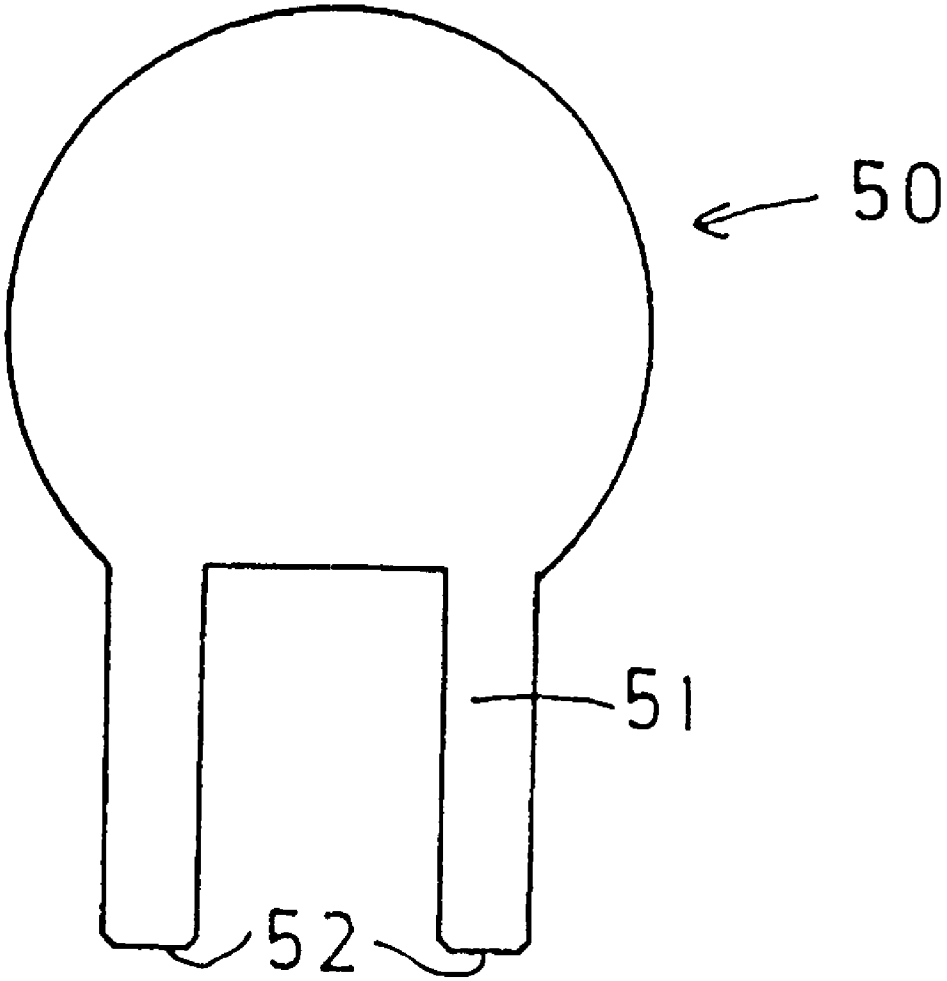

FIG. 11 A view of a tool for opening the casing.

FIG. 1 shows in cross-section an opened casing comprising two casing halves 1,2. Each casing half 1,2 is shaped like a box open on one side and having a base 3 and two longitudinal side walls 4, which are interconnected by end walls 5 upstream and downstream of the drawing plane. The free edges 6 of the side and end walls are located in on plane. Two of the facing longitudinal side walls 4 are interconnected by a film hinge 7. The side wall of one of the two casing halves remote from the film hinge 7 contains a lug or tab 8, which together with a recess 9 in the opposite side wall 4 of the other casing half forms a locking device.

In each end wall 5 is formed a semicircular recess 10, which is located at the same point of each end wall 5. If the two casings halves 1, 2 are folded together around the axis formed by the film hinge 7, then the free edges of the walls rest on one another and the two recesses 10 form a through opening, which has a circular shape.

In the corners between the longitudinal side walls and the end walls 5 are placed webs 11, which are shaped in one piece on the longitudinal side walls 4 or end walls 5 and emanate from the edges forming the junction plane between the two casing halves. They extend from the junction plane to roughly over half the depth of the casing halves, i.e. not to the base 3.

The arrangement of the webs 11 can be more clearly gathered from FIG. 2, which is a plan view from above of the arrangement of FIG. 1. The webs 11 comprise two parts 12, 13, which are in mutual extension of one another. One web part 12 is shaped on the inside of the end wall 5 and is at an angle of approximately 45° in the direction of the adjacent longitudinal side wall 4. The second web part 13 is located on the adjacent longitudinal side wall 4 and is also under an angle of approximately 45° towards the adjacent end wall 5. The faces of the web parts 12, 13 facing the corner 14 are located in a single plane. The two free edges 15, 16 of the two parts 12, 13 of the web 11 are bevelled in such a way that they form a corner with an angle of 90°. Thus, the edges 15, 16 can engage flat on the lateral faces 17, 18 of the corner of a ferrite element 19. Size tolerances of the ferrite elements 19 can be compensated by a slight yielding or deflection of the web parts 12, 13 into the interior of the corner 14.

The webs 11 present at all four corners 14 of the casing halves 1, 2 form a fixing device, in order to fix a ferrite element 19 in each casing half 1, 2. An angle compensation for the ferrite elements 19 is provided in the form of a rounded projection 20 on the base 3 of each casing half 1, 2.

The tab 8 forming part of the locking device is formed on the edge 21 of side wall 4. Its outside 22 is inwardly displaced compared with the outside 23 of the longitudinal side wall 4.

The tab 8 cooperates with the recess 9 of the facing side wall 4 of the other casing half 1. Said recess is open in the interior of the casing half 1. Ribs 25 for forming a locking means are provided on both terminal ends 24 of the recess 9, cf. FIG. 1.

In the vicinity of its two terminal edges 25, the tab 8 has in each case a detent 26, cf. FIG. 4, which is formed at the end of a spring tongue 27, which is shaped on the end face 28 of the tab 8. This means that the detent 26 secured in the rib system 25 on pulling out is wedged outwards and consequently reinforces the fixing action. As can be gathered from FIG. 2, the tab 8 has projections 29 directed towards the casing interior and which project over the inside 30 of the longitudinal side wall 4. As both longitudinal side walls 4 have the same thickness in the area of the tab 8 and the recess 9, said projections 29 still project over the inner wall when the casing is closed.

The base 3 the casing half 1 which contains the recess 9, also contains two openings 31, which are directly adjacent to the inside of the longitudinal side wall 4 having the recess 9. Through said openings it is possible for a tool to engage in the interior of the closed casing and by action on the projections 29 to disengage the detents 26 from the ribs 25.

FIG. 3 shows a longitudinal section through the left-hand casing half with recess 9 shown in FIGS. 1 and 2. Due to the fact that the rib system 25 is present on both end walls 24 of the recess 9 and also the detents 26 at both ends of the tab 8, the two detents can be fixed in the ribs 25 by expansion.

FIG. 3 also shows that the webs 11 extend from the edge to the same point where the recesses 10 terminate and together form the through opening.

FIG. 5 is an end or front view of the closed casing according to FIG. 1 to 4. With the exception of the through opening 32 formed by the two recesses 10, the casing forms a smooth outside. As both recesses 10 have the same diameter and the same spacing from the two longitudinal sides, a circular through opening 32 is formed.

In the embodiment of FIG. 6 the recesses are semicircular with the same diameter, but located at displaced or offset points of the side walls 5. This leads to the formation of a through opening 33, which forms at the interface of the two casing halves a constriction, which can be used for fixing to the cable.

In the embodiment shown in FIG. 7 the two end walls 5 of the two casing halves also have in each case on recess 34, which is non-circular in the embodiment shown, so that an oval through opening is formed when the casing is closed.

The views of FIGS. 8 to 10 correspond to those of FIGS. 3 to 1, in a somewhat modified embodiment. The restriction is limited to those parts where a modification has taken place.

As can be seen in FIG. 8, the webs for retaining the corner edges of the ferrite 19 are differently constructed. The webs 41 emanate from the base of the two casing halves and extend roughly to the centre of the height of said casing halves. The terminal edges directed towards the interface pass in side view under a right angle, in the same way as the two notch flanks 15, 16 forming the notches 42 and which correspond to the ends of the two web parts 12, 13.

On either side of the recess 9 in the side wall shown in FIG. 8 is provided a blind hole 43 emanating from the edge 21 and which receives a cylindrical pin 44. The pins 44 are shown in FIG. 10.

The tab 45 corresponding to tab 8 in the preceding embodiment is somewhat thickner, as is the associated part of the side wall 4. Once again in the base 3 of the casing half 2 containing the recess 9 are provided openings 31, through which a specialist can act with a tool on the tab 8 in order to release the locking.

FIG. 10 shows that in place of a centrally positioned film hinge there are two film hinges 7, which are located in the end region of the connection point between the two casing halves. The edges 21 of the two facing side walls 4 which are now freely available are each provided with a depression 46 and a ledge-like projection 47 corresponding thereto. On folding together the projections 47 come to rest in the depression 46. As a result of the engagement of these projections and depressions and the cooperation of the pins 44 engaging in the blind holes 43 there is an additional locking of the casing, which also makes virtually impossible a lateral twisting or shearing off of the casing halves. It is therefore virtually impossible to detach again from the cable an electric noise absorption device already fitted to a cable. This can only be done by persons having the necessary tool and knowing how it is insertable through openings 31.

FIG. 11 shows a tool 50 in the form of a key, with which the folded together casing can be reopened. The key contains two parallel, linear, cross-sectionally rectangular legs 51, whose spacing and size correspond to the spacing and size of the openings 31 in the bottom of one casing half-shell. Reference is made in this connection to FIG. 2. The legs 51 are sufficiently long in order to engage with the ends 52 on the projection 29 of the detents 26. This makes it possible to disengage the detents 26 from the ribs 25, so that the casing can be reopened.

Through the use of a special key matched to the openings 31, it is only possible for an expert to remove again the noise absorber located in the casing.

What is claimed is:

1. A device for absorbing electrical noise, comprising:

a casing having two casing halves, each casing half being shaped for receiving an element of noise preventing material; and each casing half also having two end walls, each end wall further having a through opening for an electric cable;

two elements of noise preventing material disposed in the respective casing halves, each element of noise preventing material having a semi-cylindrical groove, which when positioned around an electrical cable, forms a closed, cylindrical passage for the electrical cable;

a fixing device for fixing the elements of noise preventing material in at least one of the respective casing halves;

wherein the fixing device is a support member disposed angularly across at least one corner of an interior cavity in the at least one of the casing halves, said corner having flat, substantially perpendicular walls; and wherein the fixing device acts to support a corner portion of at least one non-recessed surface of each element of noise preventing material.

2. The device according to claim 1, wherein the fixing device is a web of material engaging the non-recessed surface of noise preventing material and located in the vicinity of and sloping towards an interior corner of the casing half.

3. The device according to claim 2, wherein the web has a notch which supports a corner of the non-recessed surface of the element of noise preventing material.

4. The device according to claim 2, wherein the web is positioned between one of the two end walls and a side wall of the casing.

5. The device according to claim 2, wherein the web is split and the ends of the two web parts engage on the non-recessed surface of the element of noise preventing material.

6. The device according to claim 5, wherein the facing ends of the two web parts are beveled.

7. The device according to claim to claim 5, wherein one web part is shaped on the end wall and the other web part on the side wall.

8. The device according to claim 2, wherein the web does not extend to a base of at least one of the casing halves.

9. The device according to claim 1 with a locking device for locking the casing in a closed state.

10. The device according to claim 9, wherein the locking device is completely housed within the casing so as not to project outside of the closed casing.

11. The device according to claim 9, wherein the locking device has a tab shaped on an edge of first one of the casing halves and which engages in locking manner in a recess in an edge of another one of the casing halves.

12. The device according to claim 11, wherein the recess in an interior of the casing is open.

13. The device according to claim 11, wherein the locking device is located on terminal edges of the recess.

14. The device according to claim 11, wherein a tab is provided in a vicinity of at least one of the end walls has a resilient locking tongue.

15. The device according to claim 11, wherein the locking system is such that it opposes opening of the casing.

16. The device according to claim 11 having at least one opening in the casing for access to the locking device.

17. The device according to claim 1, wherein the through opening for the cable is formed by two recesses in the end walls of the casing halfs.

18. The device according to claim 17, wherein the two recesses forming the through opening are arranged in displaced manner along mutually associated edges of the casing halves.

19. The device according to claim 1, wherein the through opening has a non-circular shape.

20. The device according to claim 1, wherein the two casing halves are interconnected by a film hinge.

21. The device according to claim 1, wherein the two casing halves are interconnectable by insertion and securing of at least one projection on one of the two casing halves into at least one recess on another one of the two casing halves.

22. The device according to claim 9, wherein the locking device is constructed in such a way that it can only be opened with the aid of a tool.

* * * * *